US006641056B2

(12) United States Patent
Kuykendal et al.

(10) Patent No.: US 6,641,056 B2
(45) **Date of Patent: *Nov. 4, 2003**

(54) MINIATURE FOUNTAIN

(76) Inventors: Robert L. Kuykendal, P.O. Box 950, High Ridge, MO (US) 63049; Ronald S. Deichmann, 4997 Dover La., House Springs, MO (US) 63051

( * ) Notice: Subject to any disclaimer, the term of this patent is extended or adjusted under 35 U.S.C. 154(b) by 0 days.

This patent is subject to a terminal disclaimer.

(21) Appl. No.: 09/813,143

(22) Filed: Mar. 21, 2001

(65) Prior Publication Data

US 2003/0098361 A1 May 29, 2003

(51) Int. Cl.[7] ..... B05B 17/08

(52) U.S. Cl. ..... 239/17; 239/16; 239/18; 239/99; 239/101

(58) Field of Search ..... 239/16, 17, 99, 239/101, 18

(56) References Cited

U.S. PATENT DOCUMENTS 3,630,444 A * 12/1971 Nelson ..... 239/29
4,795,092 A * 1/1989 Fuller ..... 239/23
4,955,540 A * 9/1990 Fuller et al. ..... 239/20
5,160,086 A * 11/1992 Kuykendal et al. ..... 239/18
5,213,260 A * 5/1993 Tonkinson ..... 239/11
5,641,120 A * 6/1997 Kuykendal et al. ..... 239/18

* cited by examiner

*Primary Examiner*—Robin O. Evans
(74) *Attorney, Agent, or Firm*—Henry W. Cummings

(57) ABSTRACT

The self-contained miniature laminar ornamental fountain shown in FIG. 1 comprises an enclosure and water reservoir, 5, a pump, 1, flow control means, 3, pipe or tubing means 5 to conduct water from the pump, 2, to a laminar nozzle, 6. Water in the reservoir, 1, enters the pump, 2, where it is pressurized, thence through the adjustable valve or flow control means, 4, through the tubing, 5, to the laminar nozzle, 6. The laminar stream, 7, emanating from the laminar nozzle, 6, forms a graceful arch and then falls back into the reservoir, 1, to repeat the cycle. In another embodiment of the invention the fountain includes one or more additional laminar or non-laminar nozzles nozzles. In another embodiment the fountain above in which the laminar nozzle(s) contain internal lighting means for producing lighted laminar streams. In another embodiment in the fountain, the laminar stream(s) are interrupted to form jets of water which appear to leap from place to place.

8 Claims, 15 Drawing Sheets

MINIATURE FOUNTAIN

I FIELD OF THE INVENTION

This invention discloses a complete, self-contained miniature laminar ornamental fountain, which for example may be displayed on a table top.

II BACKGROUND OF THE INVENTION

U.S. Pat. No. 5,160,086 granted Nov. 3, 1992 is directed to a lighted laminar flow nozzle for use in decorative water fountains and industrial applications. It includes fluid flow through a double-walled bladder-like fluid supply hose 32 into a fluid chamber 10 and through a diffuser material 20, past trapped air pockets 18 and exiting through a knife edged orifice 12. The fluid nozzle is mounted upon one or more stages of vibration dampening springs 30, and the outlet orifice 12 is located off center from the walls 11 of the fluid chamber so that pump surges and vibrations are greatly dampened and the output fluid stream 14 is sufficiently laminar that light is conducted through the length of the output fluid stream 14 similar to a fiber optic cable.

U.S. Pat. No. 5,641,120 granted Jun. 24, 1997 is an improvement on the first described U.S. Pat. No. 5,160,086. This U.S. Pat. No. 5,641,120 includes an improved method and apparatus for obtaining a laminar stream of fluid flow including providing a generally cylindrical outer wall 13*a*, a generally cylindrical inner wall 14 defining a generally cylindrical outer chamber 13; introducing fluid into the outer chamber 13 tangentially at 12, directing fluid flow within the outer chamber circumferentially through chamber 13; providing an inner chamber 36 defined by the generally cylindrical inner wall located within or below the outer chamber 13. An opening 33 is formed in the lower portion of the inner cylindrical wall 14, which causes fluid to flow downwardly through the opening 33 from the outer chamber 13 into the inner chamber 36. Located within the inner chamber is a diffuser material having a plurality of parallel fluid flow paths. Fluid is caused to flow through the diffuser material to dampen major currents of fluid velocity. The diffuser material has an arcuate upper surface 84. Fluid is caused to flow radially inwardly from the arcuate surface through an orifice 20 located above the diffuser material to form a laminar fluid stream.

In U.S. Pat. No. 5,785,089 granted Jul. 28, 1998 an apparatus is disclosed wherein a pressure inlet to a chamber includes a double walled bladder-like hose wherein fluid is made to flow into parallel manner, first forwardly within the tube and then backwardly in the tube, and then again forward in the tube to isolate the system from pressure variations including pump noise.

III SUMMARY OF THE INVENTION

The self-contained miniature laminar ornamental fountain shown in FIGS. 1 and 2 comprises an enclosure and water reservoir, 5, a pump, 1, an adjustable valve or other flow control means, 3, conduit means such as pipe or 2 to conduct water from the pump, 1, to a laminar nozzle, 4. Water in the reservoir, 5, enters the pump, 1, where it is pressurized, thence through the adjustable valve or flow control means, 3, through the conduit means 2, to the laminar nozzle, 4. The laminar stream, 6, emanating from the laminar nozzle, 4, forms a graceful arch and then falls back into the reservoir, 5, to repeat the cycle. In another embodiment of the invention the fountain includes one or more additional laminar or non-laminar nozzles nozzles. In another embodiment shown in FIGS. 3 and 4 in the fountain, includes pulsation reducing means 7 and shutter means 9 for interrupting the laminar stream(s) 4 to form jets of water which appear to leap from place to place. In another embodiment the laminar nozzle(s) 4 contains internal lighting means 8 for producing lighted laminar streams.

IV THE DRAWINGS

Figure 15:
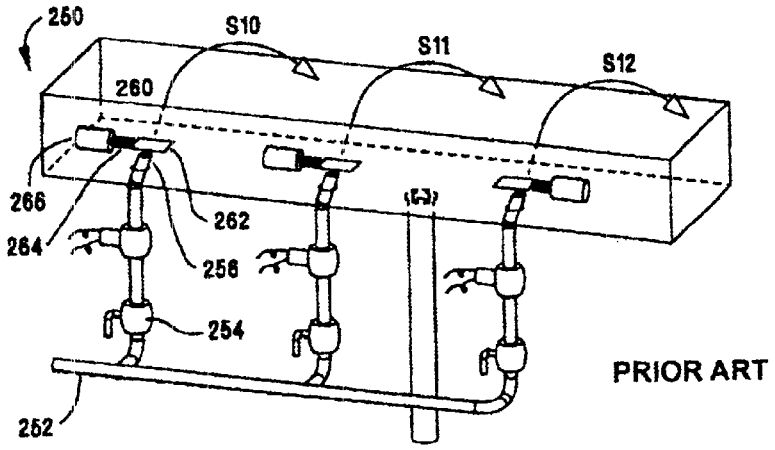
FIG. 15 is a perspective view of a prior art flow stream shutter used in a different environmoment in the closed position.
Figure 15A:
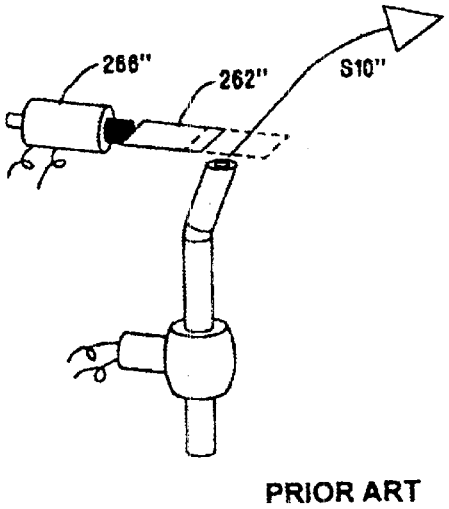

FIG. 15*a* is a perspective view of a prior art flow stream shutter used in a different environmoment in the open position.

Figure 15B:
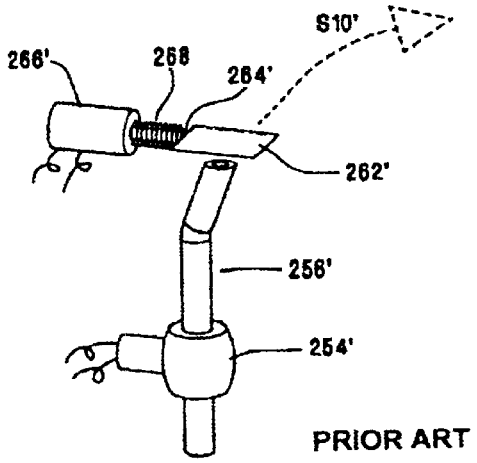

FIG. 15*b* is a perspective view of a prior art flow stream shutter used in a different environmoment in the closed position.

Figure 16:
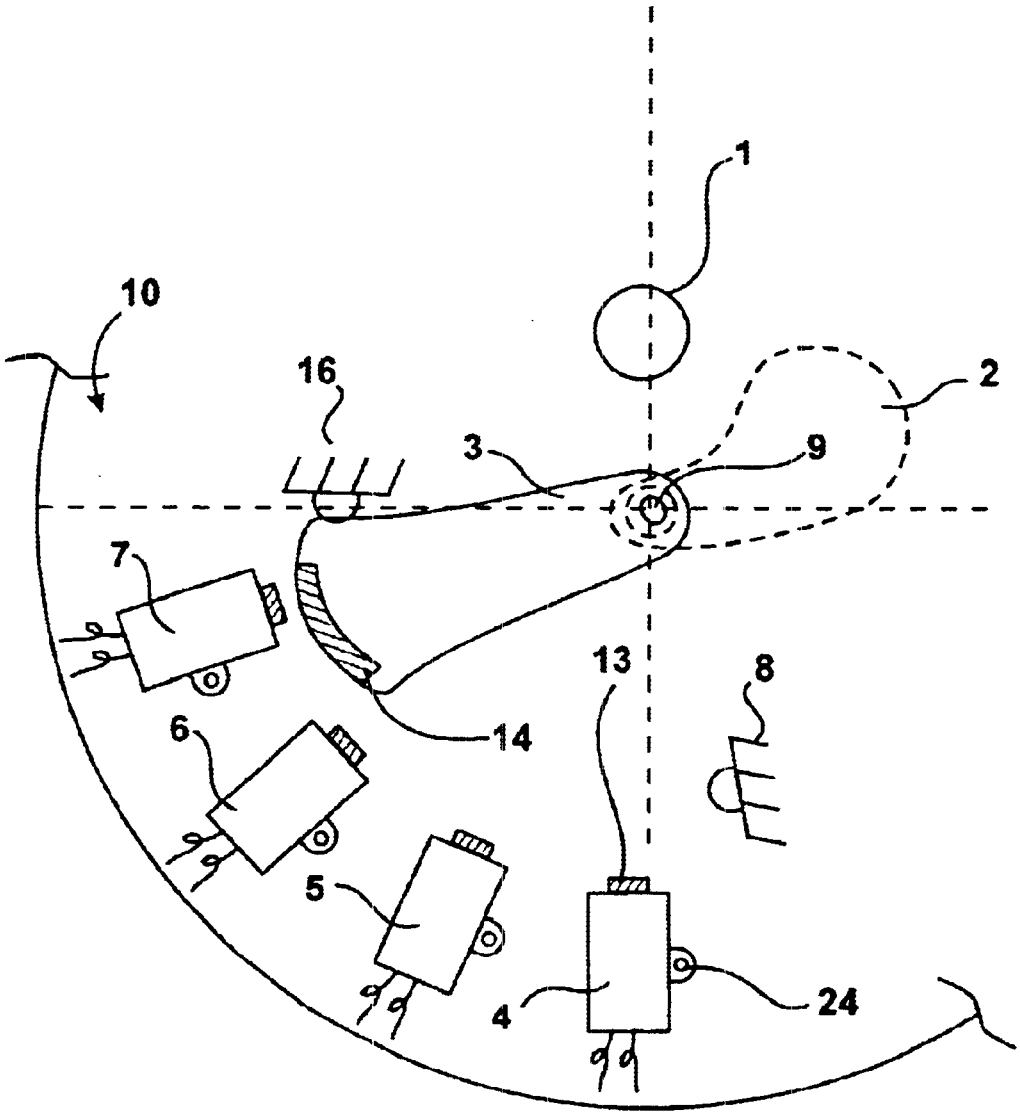

FIG. 16 is a front view of the fountain shutter of the present invention in the closed position.

Figure 17:
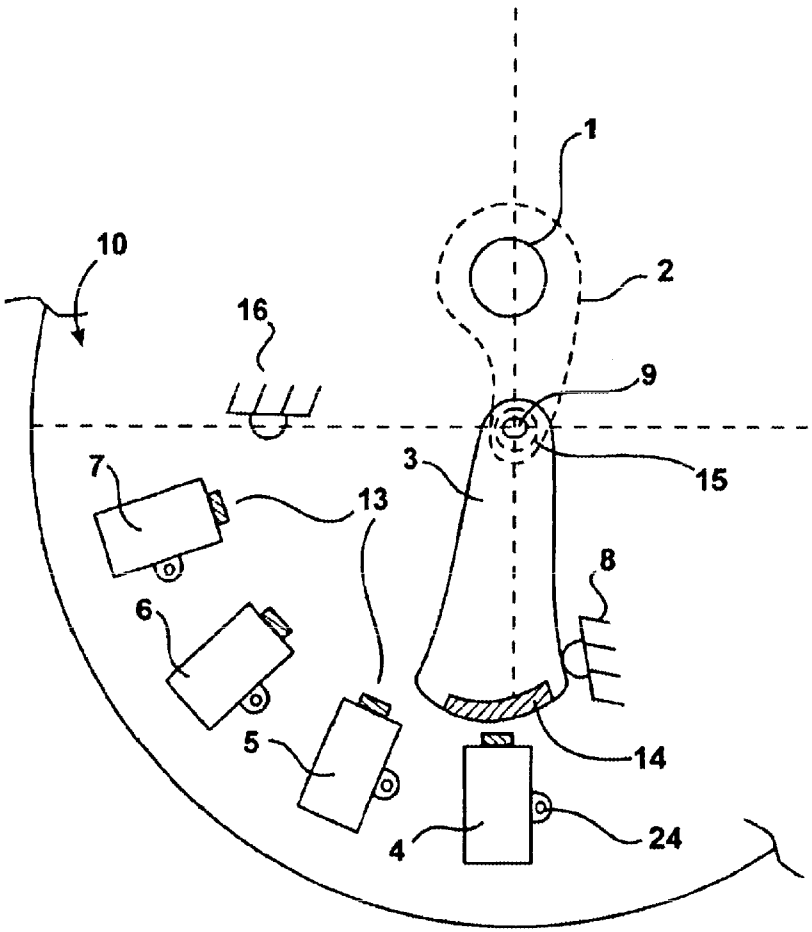

FIG. 17 is side elevation view of the fountain shutter of the present invention.

Figure 18:
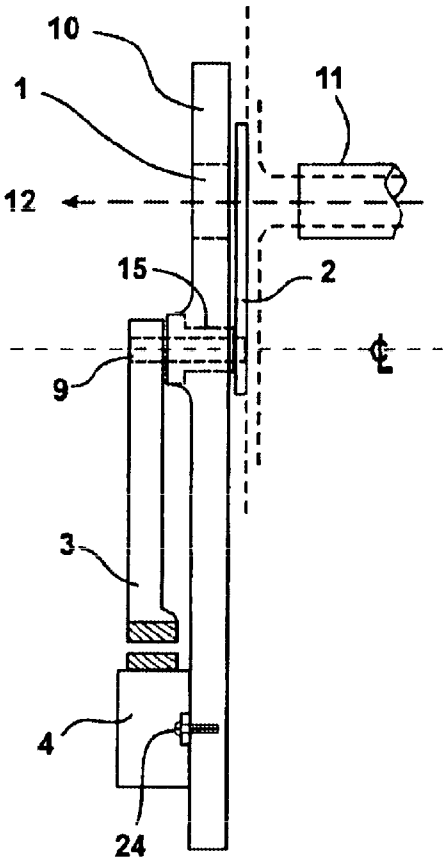

FIG. 18 is a front view of the fountain shutter of the present invention in the open position.

Figure 19:
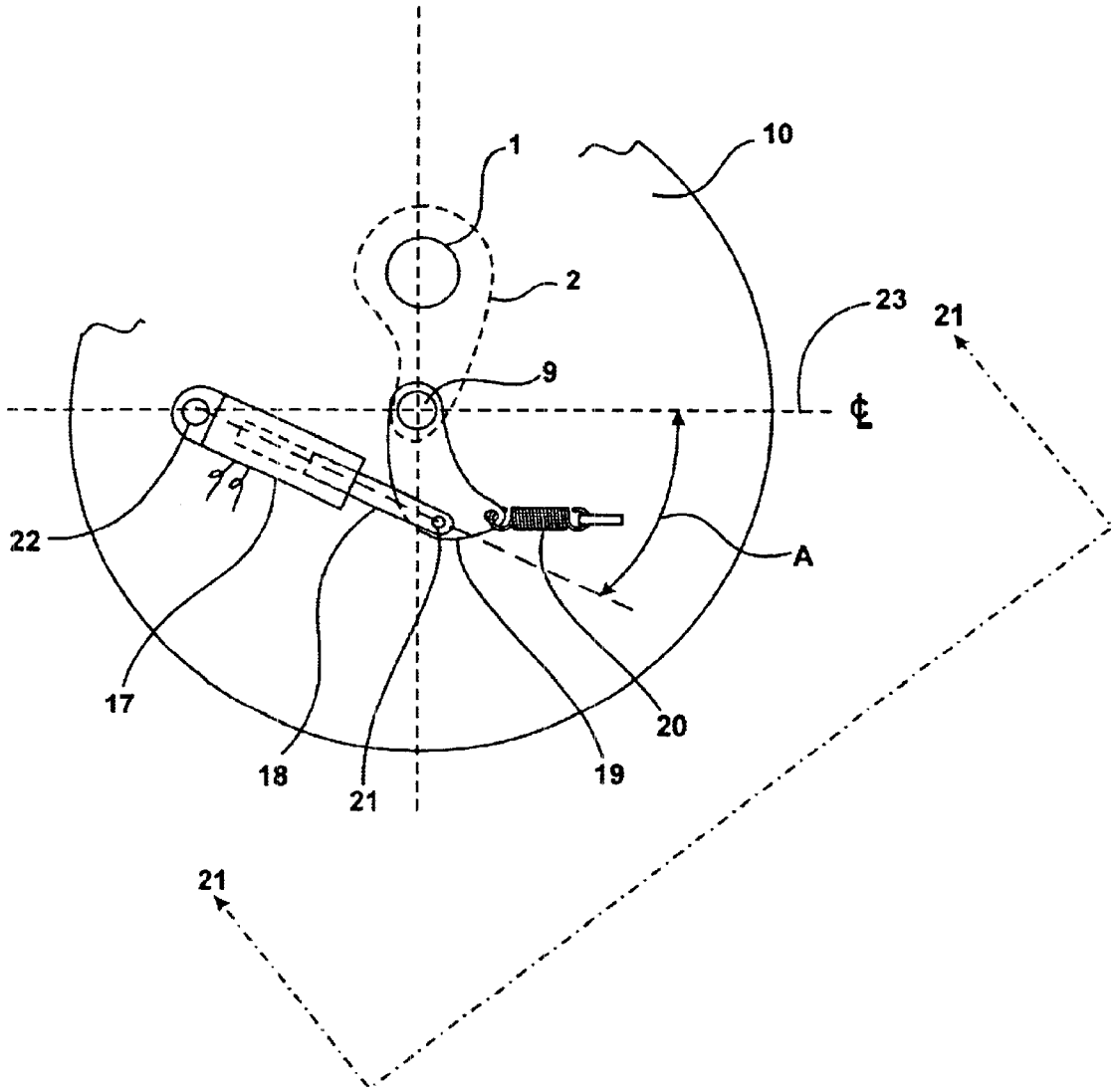

FIG. 19 is a front view of a second embodiment the of the present invention, with the shutter in the closed position.

Figure 20:
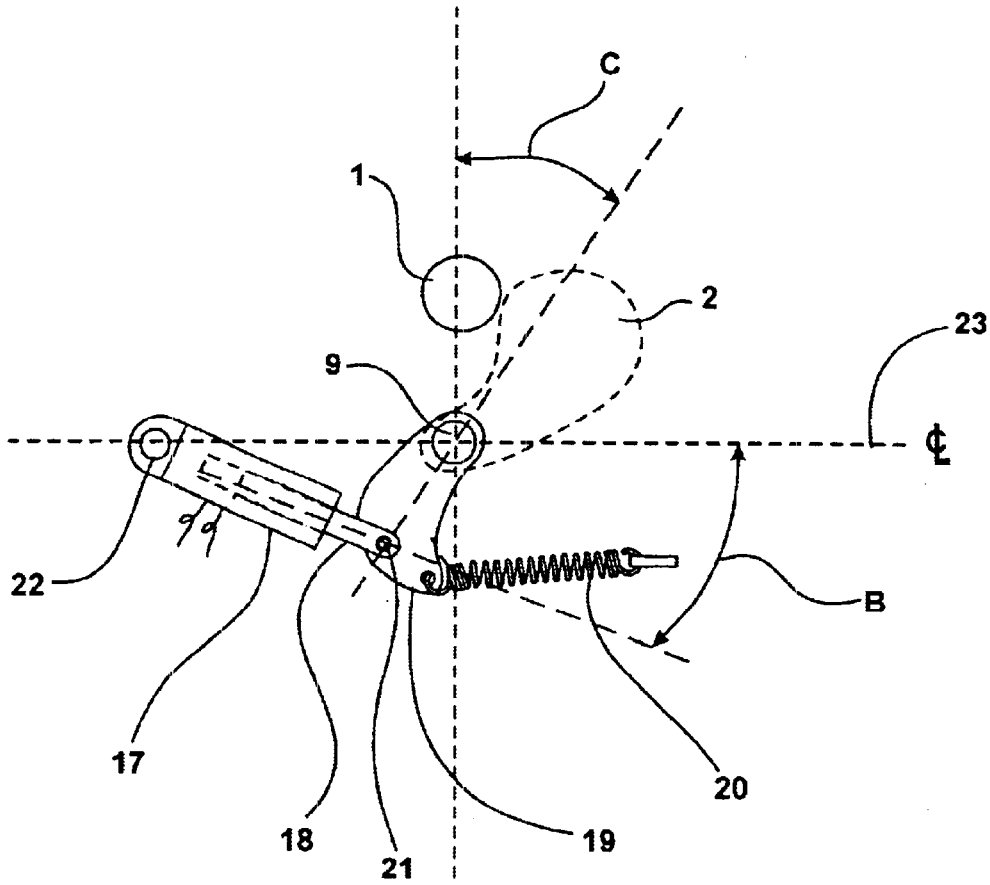
Figure 21:
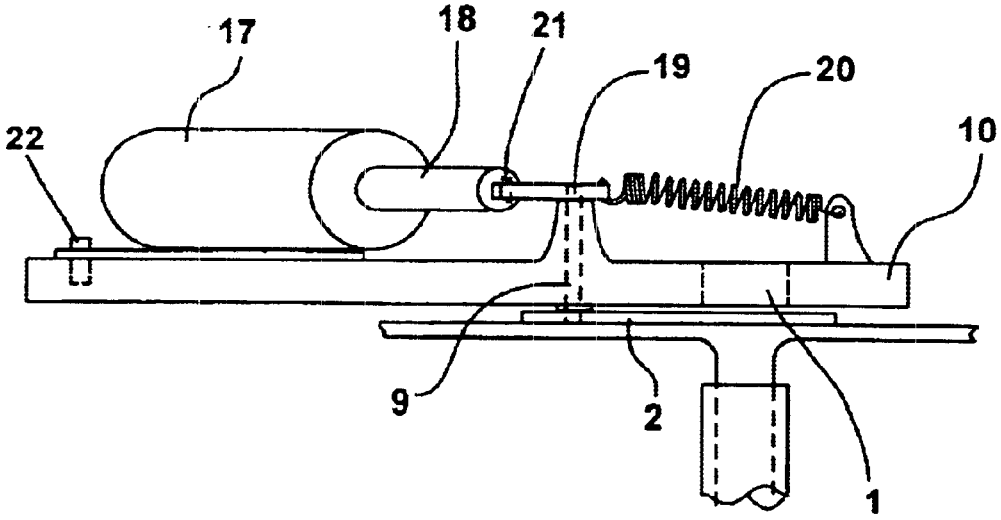

FIG. 20 is a side elevation view of the second embodiment the of the present invention, with the shutter in the open position FIG. 21 is a view looking in the direction of the arrows along the line 21—21 in FIG. 19.

Figure 22:
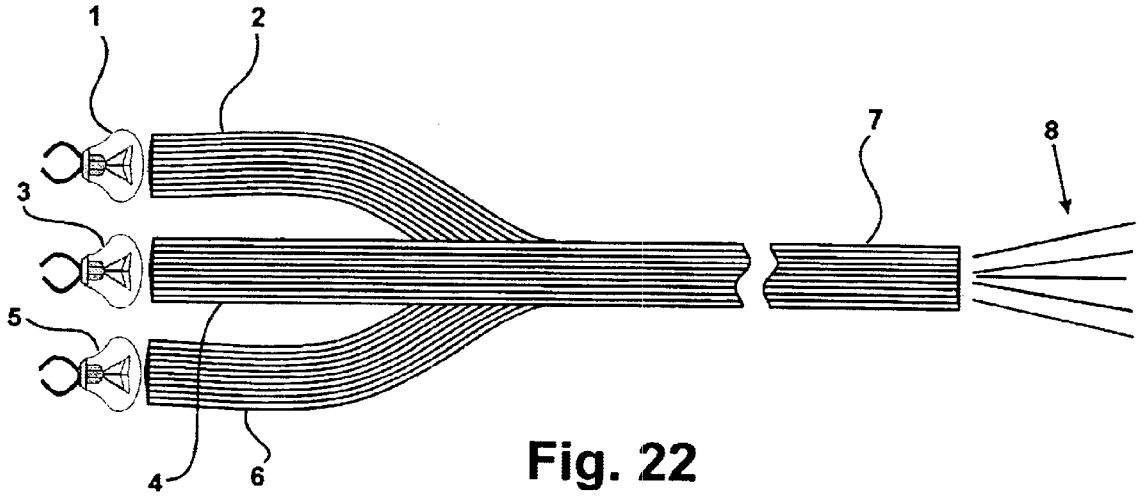

FIG. 22 is a schematic view of an embodiment including a lighting system in the nozzle.

Figure 23:
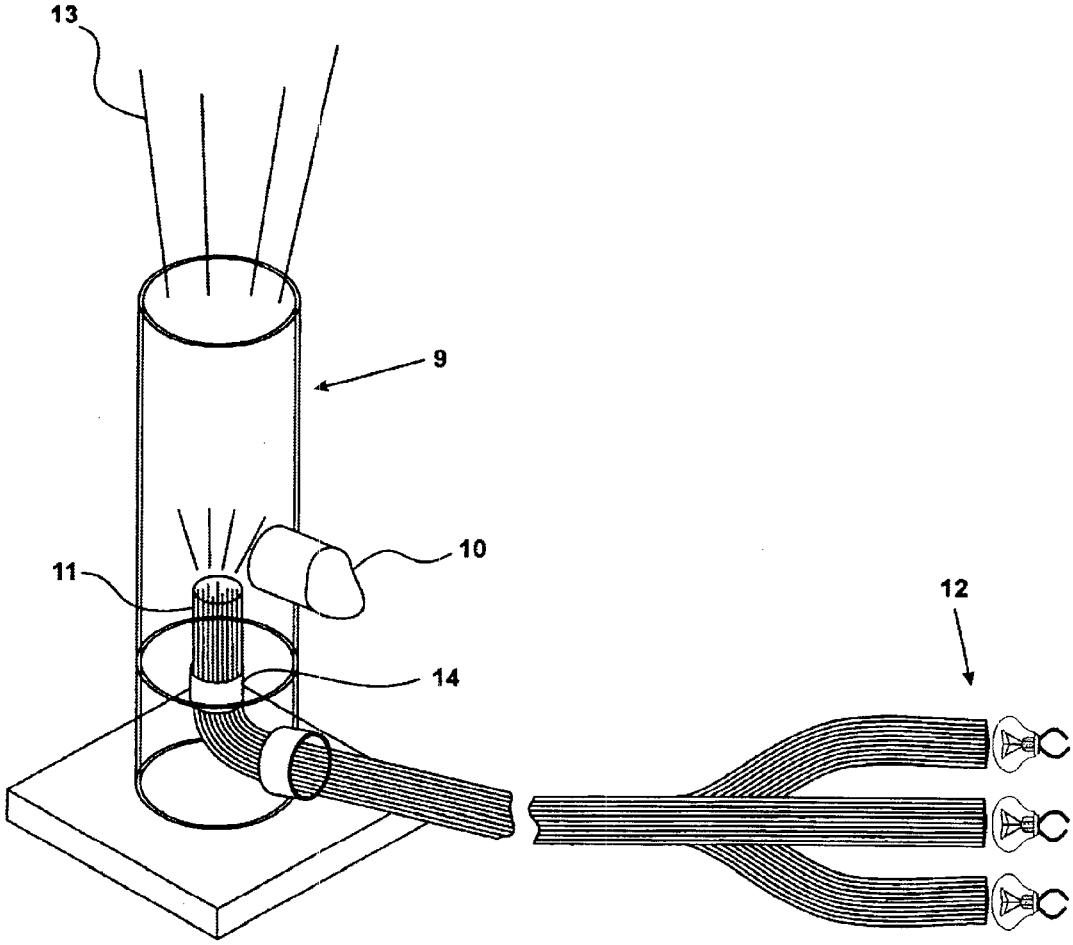

FIG. 23 is a schematic, perspective view of another embodiment of the invention directed to a decorative fountain.

V DESCRIPTION OF PREFERRED EMBODIMENTS

Figure 1:
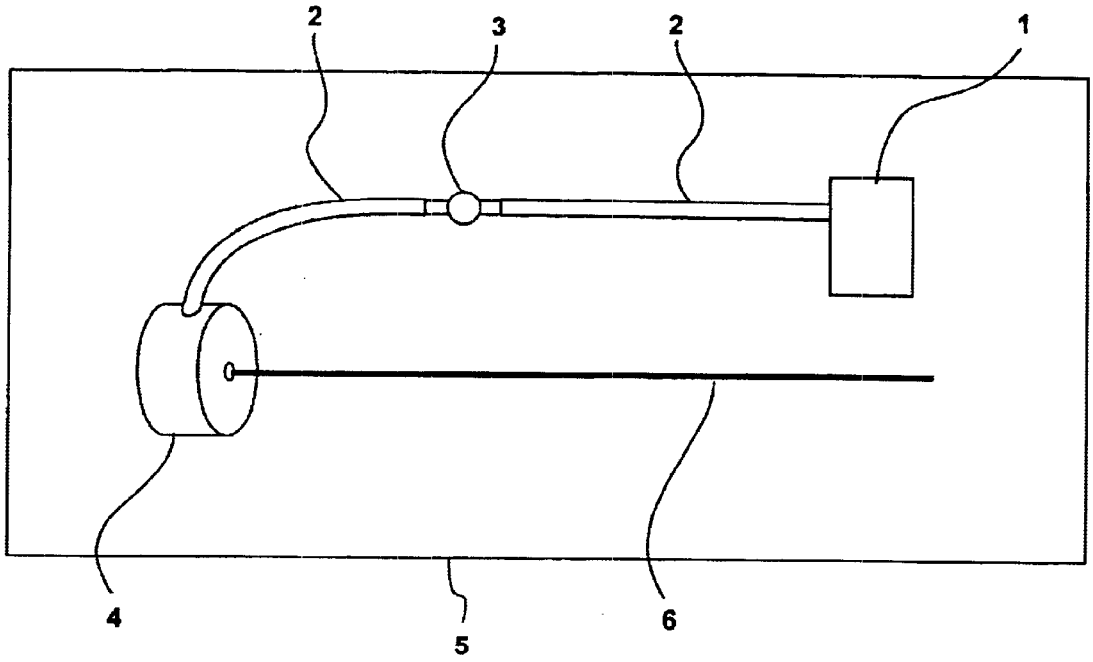
FIG. 1 is a plan view of one embodiment of the minature laminar ornamental fountain of the present invention.
Figure 2:
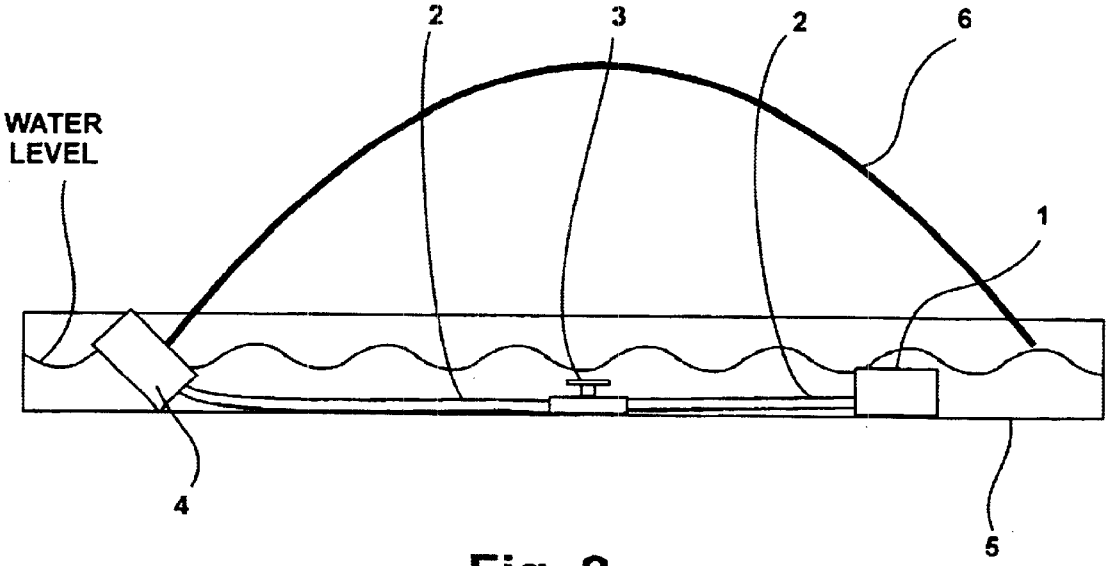
FIG. 2 is side elevation view of the the minature laminar ornamental fountain of the present invention shown in FIG. 1.

The self-contained miniature laminar ornamental fountain shown in FIGS. 1 and 2 comprises an enclosure and water reservoir, 5, a pump, 1, an adjustable valve or other flow control means, 3, conduit means such as pipe, 2, to conduct water from the pump, 1, to a laminar nozzle, 4. Water in the reservoir, 5, enters the pump, 1, where it is pressurized, thence through the adjustable valve or flow control means, 3, through the conduit means 2, to the laminar nozzle, 4. The laminar stream, 6, emanating from the laminar nozzle, 4, forms a graceful arch and then falls back into the reservoir, 5, to repeat the cycle.

Figure 3:
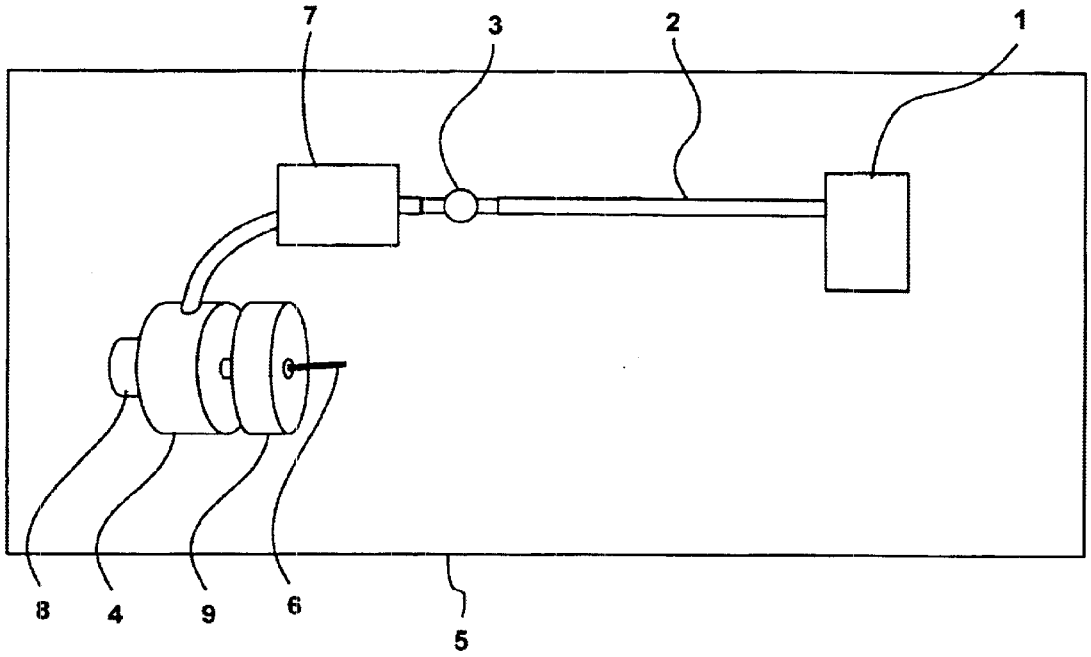
FIG. 3 is a plan view of another embodiment of the minature laminar ornamental fountain of the present invention.
Figure 4:
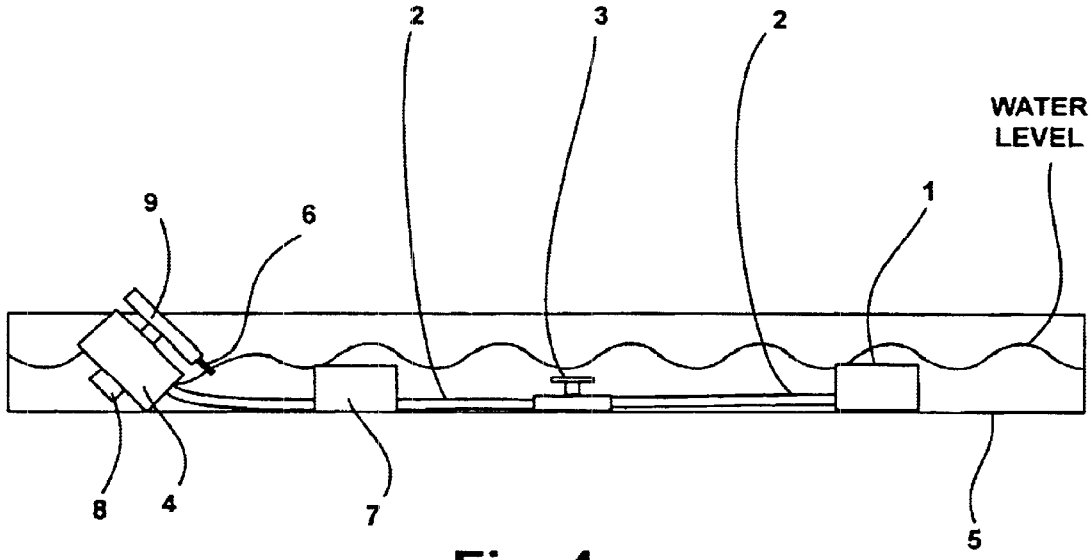
FIG. 4 is side elevation view of the minature laminar ornamental fountain of the present invention shown in FIG. 3.
Figure 5:
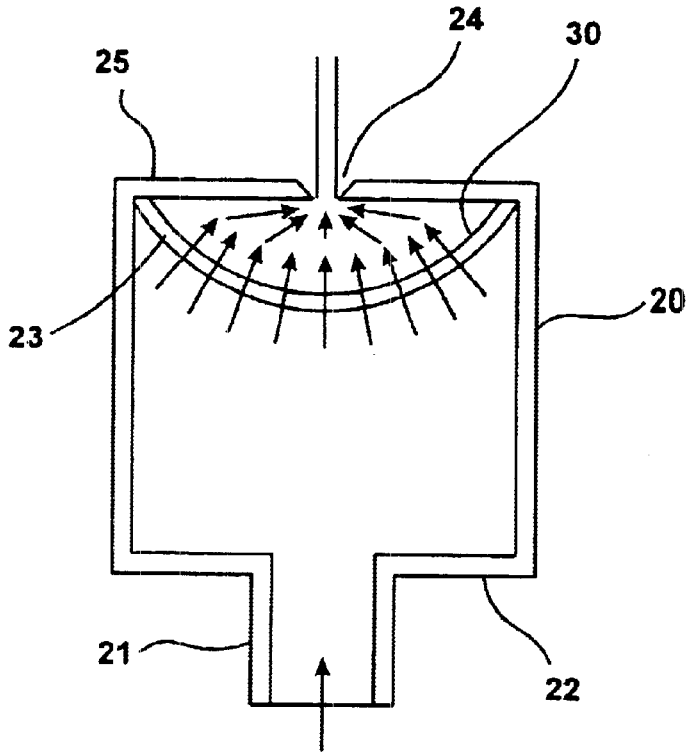
FIG. 5 is a schematic sectional view illustrating that substantially all the water flowing from the diffuser to the exit orifice travels substantially the same distance.
Figure 6:
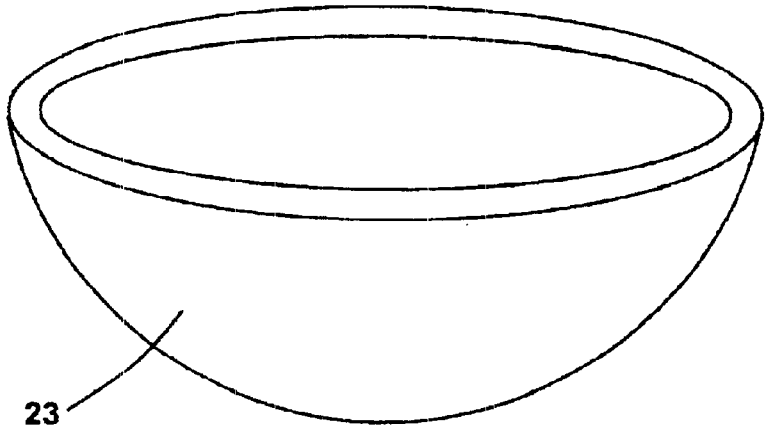
FIG. 6 is a perspective view of another embodiment of the improved diffuser of the present invention.

In another embodiment of the invention the fountain includes one or more additional laminar or non-laminar nozzles nozzles. In another embodiment shown in FIGS. 3 and 4 the fountain, includes pulsation reducing means 7 and shutter means 9 for interrupting the laminar stream(s) 6 to form jets of water which appear to leap from place to place. In another embodiment the laminar nozzle(s) 4 contains internal lighting means 8 for producing lighted laminar streams. Preferably the laminar nozzle, as disclosed and claimed in Doc. No. WW-12 hereby incorporated into the present application by this reference, as shown in FIGS. 5 and 6 comprises a cylindrical nozzle body enclosure, 20, with an entry port at-1-end, 21, a location opposite the knife-edged exit orifice 24, centered at the opposite end 25. Contained within said nozzle body, 20, is a hollow hemispherical means for diffusing 23, positioned such that the knife-edged exit orifice is at the center of the concave side 30 of the hollow hemispherical means for diffusing 23, and such that all fluid traversing from the inlet port, 21, to the exit orifice, 24, must travel through the means for diffusing, 23. The hemispherical means for diffusing 23, can be made, for example, of ½ inch to 1 inch thick polyester fiber air filter material which has been heat formed over a hemispherical mandrel.

Figure 7:
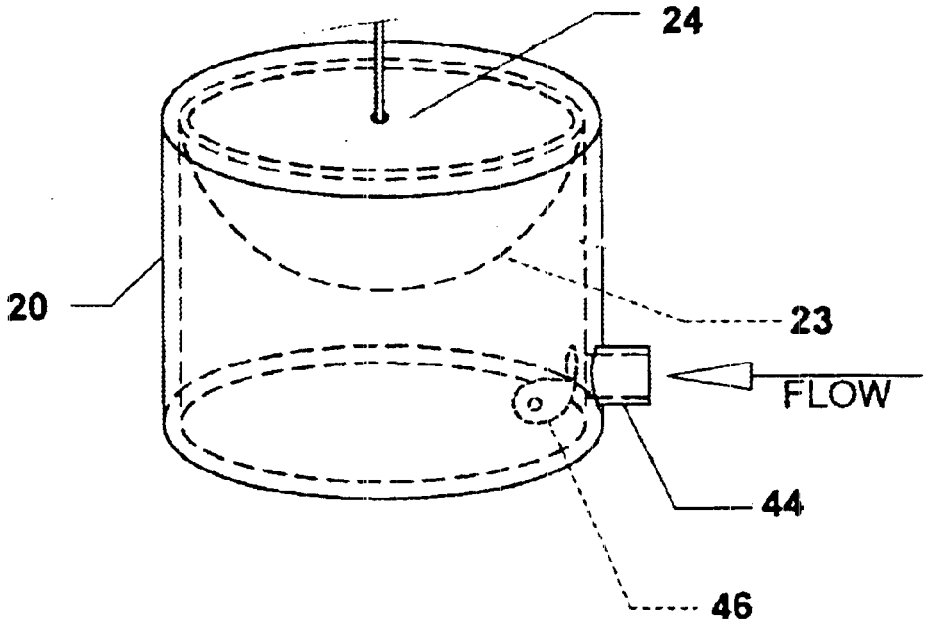
FIG. 7 is a perspective view of the improved nozzle assembly of the present invention.
Figure 8:
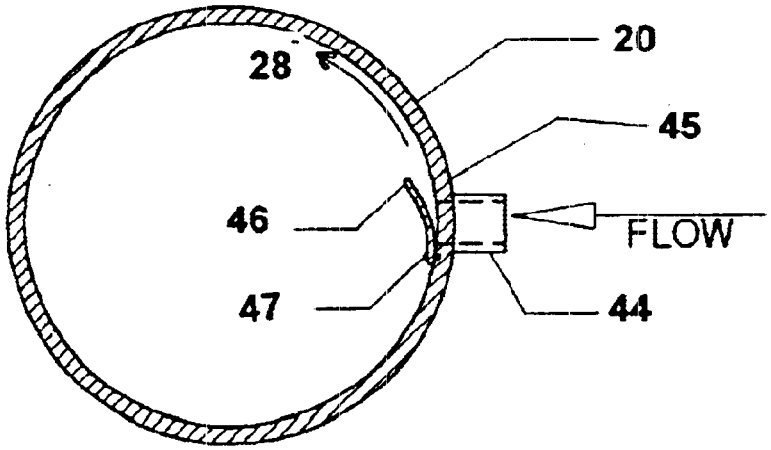
FIG. 8 is a plan view of the improved nozzle assembly of the present invention looking in the direction of the arrows along the line 8—8 in FIG. 7.

Alternatively as also disclosed in Doc. No. WW-12 hereby incorporated into the present application by this reference, shown in FIGS. 7 and 8, comprises the nozzle body, 20, diffuser, 23, exit orifice, 24. However, in this embodiment the inlet port, is moved from the center 21 of the end wall 22 to a location 44 to allow fluid to enter the nozzle body, 20, radially though the side wall 46 toward the end opposite from the exit orifice.

In another embodiment of the invention the fountain includes one or more additional laminar or non-laminar nozzles nozzles, which are operated in substantially the same manner as the single laminar nozzle shown and described above or in U.S. Pat. Nos. 5,160,086 and 5,641,120, hereby incorporated into the present application by this reference.

Figure 9:
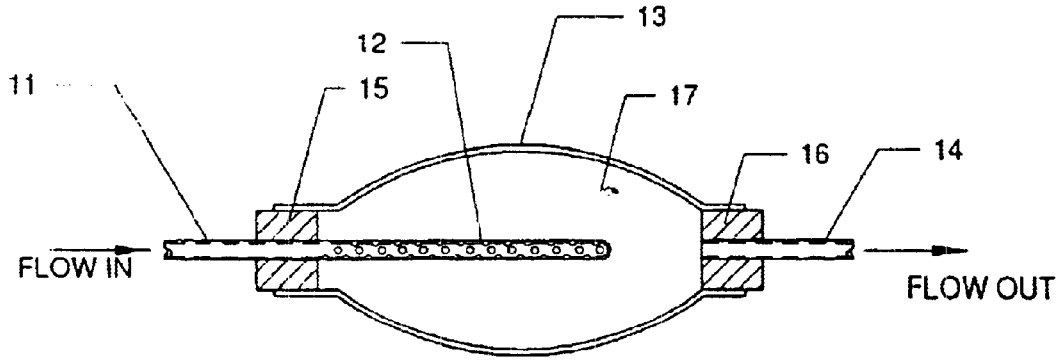
FIG. 9 is a side elavation view of one embodiment of the pulse reducing structure of the present invention.
Figure 10:
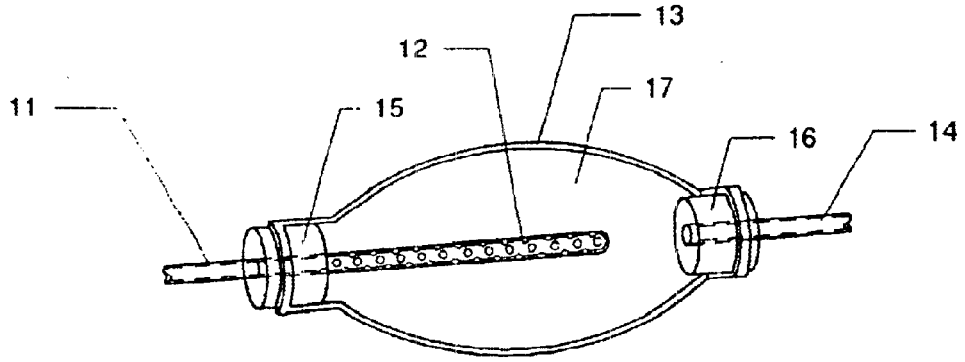
FIG. 10 is an orthagonal elavation view of the embodiment shown in FIG. 9.

In another embodiment shown in FIGS. 9 and 10 in the fountain, includes pulsation reducing means 7 disclosed and claimed in docket No. WW-16 hereby incorporated into the present application by this reference. FIG. 1 shows an enclosed vessel, 17, with an outlet pipe 14, end caps, 15 and 16, and side walls, 13, made of an elastic, bladder-like material. The inlet rigid pipe, 11, is perforated with a large number of lateral holes, 12, all of which are substantially smaller than the internal diameter of pipe, 11. In this example the pipe internal diameter is ½" and the lateral holes are each 18" diameter and there are 24 of them spaced at random along the length of the pipe, 11. Pressurized fluid made to flow in through the inlet pipe, 11, will tend to flow out through the various lateral holes, 12, at differing increments of their periodic pressure cycles and into the enclosed vessel, 17. Remaining slight pressure variations will also tend to be absorbed and smoothed by expansion and contraction of the bladder-like sidewall, 13. Fluid then flowing out from the enclosed vessel 17, through outlet pipe, 14 will be substantially free of slight pressure variations or "pump noise". FIG. 10 shows an othogonal view of the described device.

Figure 11:
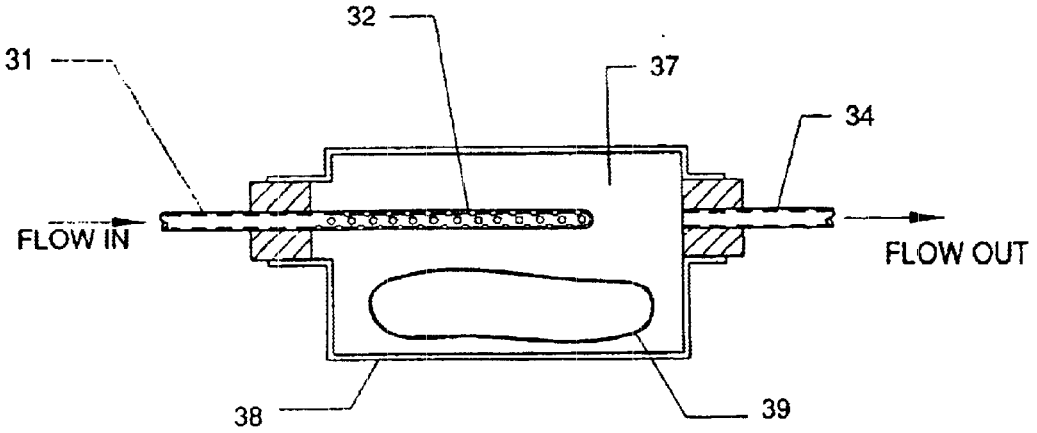
FIG. 11 is a side elavation view of another pulse reducing embodiment of the present invention.

Another embodiment of the invention shown in FIG. 11 comprises a substantially rigid inlet pipe which is perforated with a large number of lateral holes, 32, an outlet pipe, 34, and an enclosed vessel, 38. Within the enclosed vessel, 38, is a balloon-like, gas filled chamber, 39, which functions like the bladder-like sidewalls, 13, of FIG. 9 to expand and contract to absorb minute pressure pulsations.

Figure 12:
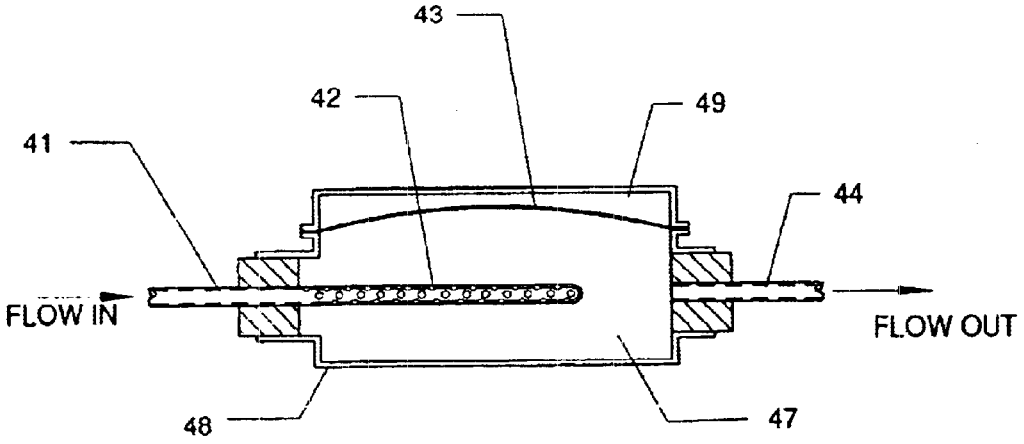
FIG. 12 is a side elavation view of another pulse reducing embodiment of the present invention

Another embodiment of the invention shown in FIG. 12 comprises a substantially rigid inlet pipe, 41, which is perforated with a large number of lateral holes, 42, an outlet pipe, 44, and an enclosed, substantially rigid chambered vessel, 48. In this embodiment said chambered vessel, 48, comprises a fluid chamber, 47, and a gas chamber, 49, separated by an elastic, bladder-like membrane, 43. In this embodiment, pulsations remaining after the fluid has entered through the inlet port, 41, and flown through the lateral holes, 42, will tend to be absorbed by expansion and contraction of the bladder-like membrane, 43, and the consequent compression and expansion of the enclosed gas chamber, 49.

Figure 13:
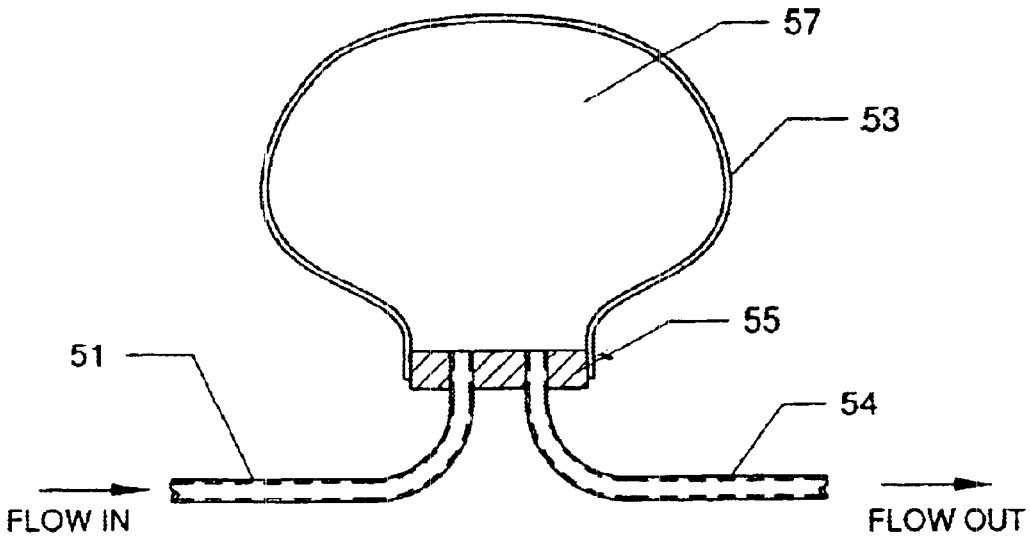
FIG. 13 is a side elavation view of another pulse reducing embodiment of the present invention.

Another embodiment of the invention, shown in FIG. 13, comprises a substantially rigid inlet pipe, 51, an enclosed chamber, 57, surrounded by an elastic, bladder-like enclosure, 53, with an outlet pipe, 54, and an end cap, 55. In this embodiment pulsations tend to be absorbed by expansion and contraction of the bladder-like enclosure.

Figure 14:
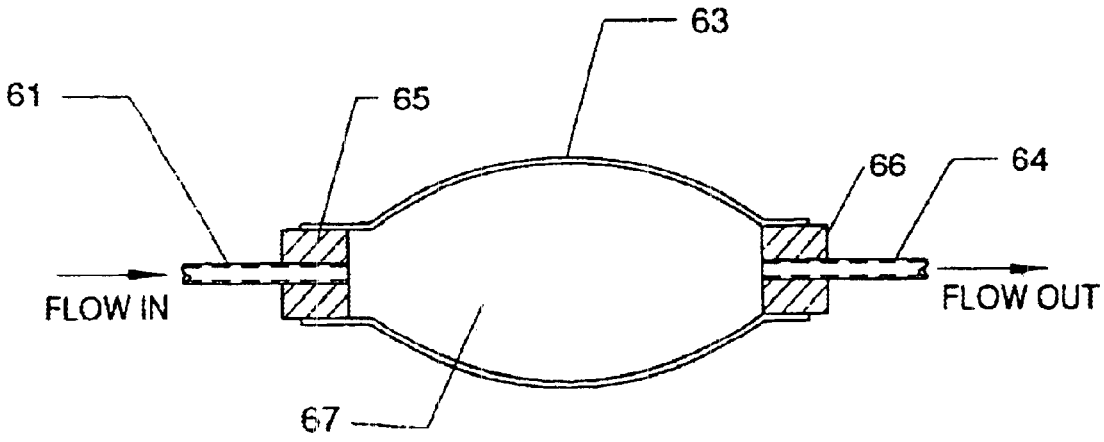
FIG. 14 is a side elavation view of another pulse reducing embodiment of the present invention.

Another embodiment of the invention, shown in FIG. 14, comprises a substantially rigid inlet pipe, 61, projecting through an end cap, 65, into a chamber, 67, with an outlet pipe, 64, projecting through a second end cap, 66. Said chamber is enclosed by a bladder-like membrane, 63. Pressurized fluid that is made to pass through inlet pipe, 61, contains pulsations which tend to be absorbed by the expansion and contraction of the bladder-like membrane, 63. The fluid then flows out through outlet pipe, 64, with the pulsations substantially reduced.

This invention also includes a Fountain Shutter described in Doc. Nos WW-15 hereby incorporated into the present application by this reference as if fully set forth herein.

As shown in FIGS. 16–18, the fountain nozzle is placed behind a cover, 10, with an exit aperture, 1, and a shutter, 2, which prevents or allows the stream, 12, to exit, according to its rotational position around shaft, 9, and bearing, 15. The opening and closing of said shutter, 2, is controlled by armature, 3, with its tip, 14, composed of iron or other magnetic material. The armature, 3, is affixed to the rotational shaft, 9. The armature magnetic tip, 14, is positioned in close proximity to electromagnets 4, 5, 6 and 7 with their magnetic cores, 13, mounted on cover 10, with fasteners 24 such that the armature, 3, stays positioned against bumper, 8, whenever electromagnet, 4, remains activated and consequently shutter, 2, continues to block the exit port 1 and no water is discharged.

By de-activating electromagnet, 4, and then sequentially activating electromagnet 5, then, 6, and then 7, the armature, 3, is made to rotate upon shaft, 9, and the shutter, 2, which is affixed to shaft, 9, will move so that it is no longer blocking exit orifice, 1, and the stream will traverse through exit aperture, 1, in the direction, 12. So long as pressurized water is made to flow from nozzle, 11, and electromagnet, 7, remains energized, then the armature, 3, will remain positioned against bumper, 16, FIG. 18, and water will continue flowing in direction, 12.

In order to stop the flow 12, electromagnet, 7, is deenergized and electromagnets 6, 5 and 4 are energized in sequence to move the armature, 3, in the direction of bumper, 8, to close shutter 2.

FIGS. 16–18 disclose four electromagnets but this embodiment may be made to work just as well with two or three or any number of electromagnets.

In an alternate embodiment shown in FIGS. 19–21, the exit aperture, 1, the shutter, 2, and the rotating shaft, 9, are the same as in the previous embodiment. However, the means of rotating the shaft and opening the shutter utilize a plunger type electrical solenoid, 17, which retracts a plunger, 18, which is attached by a pin, 21, to a lever, 19, to overcome the force of a tension spring, 20, whenever the solenoid is electrically actuated as shown in FIG. 20. The solenoid, 17, is mounted to the cover, 10, by means of a pivot, 22, which permits the solenoid and plunger to maintain proper alignment with pin 21, by rotation of a few degrees around pin 21 to compensate for the rotation of lever 19.

FIG. 19 shows solenoid 17 in deactivated position which consequently has allowed tension spring 20 to retract and withdraw plunger 18 from solenoid 17. This action has rotated lever 19 around shaft 9 to which it is affixed, and has rotated shutter 2, also affixed to shaft 9, into the closed position. Angle A shows the rotational position of the solenoid relative to the centerline 23, around pin 22.

As an example, the angle A may be about 10 to 40 degrees, the angle B may be about 5 to 30 degrees, and the angle C may be about 30 to 60 degrees.

Also, the action of the spring and the plunger could be reversed as would be obvious to one skilled in the art.

In another embodiment the fountain described herinabove the laminar nozzle(s) contain internal lighting means for producing lighted laminar streams, as disclosed in U.S. Pat. Nos. 5,160,086 and 5,641,120, or in Docket No. WW-17, hereby incorporated into the present application by this reference.

In FIG. 22, individual light source color A, 1, illuminates the end of fiber optic bundle, 2, and the light from color A, 2, travels the length of bundle, 2, where it joins and becomes part of the combined fiber optic bundle, 7, and shines out the far end of combined fiber optic bundle, 7, as the resulting light, 8. Likewise when light source color B, 3, is illuminated, the light travels the length of fiber optic bundle, 4, where it becomes part of the combined fiber optic bundle, 7, and shines out the end of combined fiber optic bundle, 7, as part of the resulting light, 8. Likewise when color C light source, 5, is illuminated, the light travels the length of fiber optic bundle, 6, where it becomes part of the combined fiber optic bundle, 7, and shines out the end of combined fiber optic bundle, 7, as part of the resulting light, 8. Individual fibers comprising bundles, 2, 4 and 6 are substantially intertwined and mixed into the combined fiber optic bundle, 7, so that the resulting light, 8, is comprised of multiple individual points of light and the resulting color tends to be a mix of the originating source colors, color A, 1, color B, 3 and color C, 5.

FIG. 23 illustrates three source color lights and three individual fiber optic bundles, collectively indicated at 12 and combined fiber optic bundle, 11, routed through a water light seal, 14, into the base of an ornamental fountain nozzle. In a manner familiar to any practitioner of the art of ornamental fountains, pressurized water is made to flow into inlet port, 10, of fountain nozzle, 9, creating an output stream, 13. With this invention, however, the output stream, 13, may be illuminated to any color or intensity within the limits of the three color light sources indicated at, 12.

In operation, then any individual source light may be turned on or off as desired. For example, if source color A, 1, is blue and source color B, 3, is green, then if only source color A, 1, is turned on the resulting light, 8, will be blue. Likewise if only source color B, 3, is turned on the resulting light, 8, will be green. However, if both source color A, 1, and source color B, 3, are turned on then the resulting light, 8, will be yellow. Any number of source color lights, 2 or more, may be combined in this manner and the individual source color lights may be of any color, type, or intensity such as incandescent, laser or LED, red, green or whatever. Also, this method and apparatus may be used for other applications in addition to fountain light.

In another embodiment in the fountain, the laminar stream (s) are interrupted to form jets of water which appear to leap from place to place, as disclosed for example in U.S. Pat. No. 5,678,617 and shown in FIGS. 4–6 therein, hereby incorporated into the present application by this reference.

What is claimed is:

1. An improved mimature laminar nozzle fountain assembly comprising:

a fountain enclosure including a water reservoir;

means for causing fluid to enter the nozzle assembly;

a diffuser located within said assembly;

said diffuser comprising a porous filter formed into a hollow hemisphere having a generally convex surface and a generally concave surface;

said generally concave surface having a center spaced from said generally concave surface;

an exit orifice spaced from said generally concave surface and located generally at said center, whereby as said fluid flows through said hollow hemispherical diffuser it has its Reynold's Number significantly reduced, and any turbulences on said convex surface tend to be converted to a very great number of micro-turbulences which tend to be self canceling and substantially all water flowing from the diffuser to the exit orifice has substantially the same distance to travel from substantially all directions, and the fluid exiting said orifice is highly laminar; said mimature laminar ornamental fountain being sized to be set and displayed on a table top; and whereby said highly laminar stream emanating from said laminar nozzle forms a graceful arch and then falls back into said reservoir.

2. An improved nozzle assembly according to claim 1 wherein said diffuser is made of polyester fiber air filter material.

3. An improved nozzle assembly according to claim 2 wherein said material is about ½ inch to 1 inch thick.

4. An improved nozzle assembly according to claim 3 wherein material has been heat formed over a hemispherical mandrel.

5. An improved mimature laminar nozzle fountain assembly comprising:

a fountain enclosure including a water reservoir;

a generally cylindrical nozzle body having an exit orifice, a continuous wall and an end opposite from said exit orifice;

an inlet port for causing fluid to enter the nozzle assembly radially though said wall toward said end;

a diffuser located within said assembly;

said diffuser comprising a porous filter formed into a hollow hemisphere having a convex surface and a concave surface having a center;

an exit orifice located generally at said center;

a blade located on the inside of said wall directly in front of said inlet port, whereby water entering through said inlet port is forced to flow in a generally circular direction flow, whereby said circular flow will tend to distribute water flow and turbulence evenly whereby as said fluid flows through said hollow hemispherical diffuser it has its Reynolds Number significantly reduced, and turbulences on said convex side of said diffuser tend to be converted to a large number of micro-turbulences which tend to be self canceling and substantially all water flowing from said diffuser to the exit orifice has substantially the same distance to travel from substantially all directions, and the fluid exiting said orifice is highly laminar; said mimature laminar ornamental fountain being sized to be set and displayed on a table top and whereby said highly laminar stream emanating from said laminar nozzle forms a graceful arch and then falls back into said reservoir.

6. An improved nozzle assembly according to claim 5 wherein said diffuser is made of polyester fiber air filter material.

7. An improved nozzle assembly according to claim 6 wherein material has been heat formed over a hemispherical mandrel.

8. An improved nozzle assembly according to claim 6 wherein said material is about ½ inch to 1 inch thick.

* * * * *